US009733045B1

(12) United States Patent
Bozek

(10) Patent No.: US 9,733,045 B1
(45) Date of Patent: Aug. 15, 2017

(54) FOLDING SIGHT ASSEMBLY

(71) Applicant: PMD3, LLC, Holyoke, MA (US)

(72) Inventor: David Bozek, Holyoke, MA (US)

( * ) Notice: Subject to any disclaimer, the term of this patent is extended or adjusted under 35 U.S.C. 154(b) by 0 days.

(21) Appl. No.: 15/299,813

(22) Filed: Oct. 21, 2016

Related U.S. Application Data

(60) Provisional application No. 62/244,879, filed on Oct. 22, 2015.

(51) Int. Cl.
*F41G 1/00* (2006.01)
*F41G 1/08* (2006.01)
*F41G 1/28* (2006.01)

(52) U.S. Cl.
CPC *F41G 1/08* (2013.01); *F41G 1/28* (2013.01)

(58) Field of Classification Search
CPC ..... F41G 1/16; F41G 1/18; F41G 1/26; F41G 1/06; F41G 1/033
USPC ..... 42/135, 136, 137, 115, 125, 126
See application file for complete search history.

(56) References Cited

U.S. PATENT DOCUMENTS 4,200,989 A * 5/1980 Brouthers ..... F41G 1/26 42/137
5,388,335 A * 2/1995 Jung ..... F41G 1/26 42/115
7,526,890 B1 * 5/2009 Keng ..... F41G 1/18 42/111
7,610,712 B2 * 11/2009 Ertl ..... F41G 1/10 42/137
9,062,931 B2 * 6/2015 Troy ..... F41G 1/08

* cited by examiner

*Primary Examiner* — J. Woodrow Eldred
(74) *Attorney, Agent, or Firm* — Doherty, Wallace, Pillsbury & Murphy, P.C.

(57) ABSTRACT

A folding sight assembly, comprising a housing having a lower region that is configured to hold a crosslock, and an upper region comprising a catch plate separated from a windage adjustment plate by a space. The assembly comprises a shaft and an engagement spring. The engagement spring comprises a longitudinally extending body that turns to form a retaining loop portion comprising an arcuate-shaped member having an opening formed therethrough. The shaft is disposed through the opening of the engagement spring and within the space formed between the windage adjustment and catch plates, and the engagement spring is further engaged with the housing and the crosslock to secure the component parts of the folding sight assembly to one another.

12 Claims, 17 Drawing Sheets

FOLDING SIGHT ASSEMBLY

BACKGROUND OF THE INVENTION

1. Field of the Invention

The present invention relates to sighting devices for weapons, and more particularly, to folding sights and elevation adjustment sights and to their securing crosslock assemblies.

2. Background of the Invention

A typical folding sight and crosslock unit for the existing AR M4/M16 weapons system comprises a folding sight assembly and a crosslock assembly. The folding sight assembly typically comprises a housing, an aperture, and a windage adjustment knob, wherein such components commonly are held together by accessory parts, such as, e.g., a ball and spring, a press fit pin and retaining ring, and/or a threaded fastener and a rotating fastener seat, thereby making the total number of accessory parts oftentimes in excess of about 9 parts.

Additionally, crosslock assemblies, which are oftentimes used to lock the housing of the folding sight assembly in a vertical upright position while the sight is in use, and securely folded down when not in use, typically employ numerous accessory parts.

Similarly, the folding sight may have an elevation adjustment sight ability. Accordingly, a typical elevation adjustment sight and crosslock unit comprises an elevation adjustment sight assembly and a crosslock assembly, wherein the elevation adjustment sight allows elevation adjustment sight for sighting and targeting at ranges of, for example, up to about 300, 400, 500 and 600 meters. However, this assembly, which typically includes about 7 to 9 moving parts, is not manageable and is impractical due to the complexity of packaging so many parts.

Accordingly, what is needed is a folding sight and crosslock unit and an elevation adjustment sight and crosslock unit that may be assembled with fewer accessory parts than what is currently known.

BRIEF SUMMARY OF THE INVENTION

The above-referenced problems and deficiencies of the prior art are overcome or alleviated by a folding sight and crosslock unit comprising a specially developed housing, aperture, crosslock, and base, wherein such specially developed components reduce the number of accessory parts used in conventional folding sight and crosslock assemblies. Additionally, the folding sight and crosslock unit further includes an inventive engagement spring, wherein the engagement spring assists in reducing the number of accessory parts necessary for engagement of the aperture to the housing, wherein such a reduction simplifies manufacture and assembly of the assembly. More particularly, in an exemplary embodiment, the folding sight and crosslock unit eliminates the ball and spring combinations and fasteners, threads, retaining rings or press fit pins typically found in conventionally-known systems, as the engagement spring performs four functions simultaneously, thereby, replacing, e.g., the 6 parts presently existing in a Troy sight, and, e.g., the 5 parts currently found in a Diamondbead U.S.A. sight.

In an exemplary embodiment, the engagement spring comprises a body that fits into grooves formed on the aperture, and which flexes to allow rotation of the aperture; a retaining hook that secures horizontal motion of the housing by locating in a hole disposed on the housing, and which further secures the windage adjustment knob in place, and which facilitates removal of the windage adjustment knob; a retaining loop that expands around the windage adjustment knob and locks in a groove formed thereon thereby preventing removal of the windage adjustment knob; and a windage adjustment knob lock that locates the windage adjustment knob and prevents rotation of the windage adjustment knob.

An additional purpose of the engagement spring is to decrease the number of moving parts in the folding sight and crosslock unit to thereby assist in the formation of an elevation adjustment sight and crosslock assembly for use on, e.g., an AR M4/M16 weapon system. The elevation adjustment sight and crosslock assembly comprises the engagement spring in association with a specially configured aperture, housing, and windage adjustment knob; and, in addition, includes a novel lift spring which operates in association with a specially designed lift dial and windage carrier to reduce the number of accessory parts needed to assemble the elevation adjustment sight and crosslock assembly. The lift spring is configured to lock the lift dial to the windage carrier and to create vertical tension for maintaining elevation adjustment sight, wherein the elevation adjustment sight is created by rotating the lift dial using a cam shaped profile that physically pushes the windage carrier discrete vertical distances to accomplish the required sighted range. This rotation is held in place by the elevation dial lock.

In an exemplary embodiment, the lift spring comprises a body that flexes to retain a vertical position due to rotation of the lift dial; a retaining hook that locks the lift dial to the windage carrier to prevent removal; a retaining loop that expands around the lift dial and locks in a groove formed on the housing to prevent the removal of the lift dial; and a dial lock that secures elevation adjustment sight over a range of distances.

The inventive assembly of the present invention further comprises an inventive crosslock assembly which decreases the number of accessory parts needed to assemble the assemblies disclosed herein (from about 6-7 machined aluminum parts to about 4 parts) and which also increases the strength of such assemblies. The crosslock assembly uses a tombstone-shaped profile to minimize the material removed from the base and housing for strength. The round feature of the tombstone, which seats into the housing, partners with the rounded features of the base and housing for assembly. The square surface of the tombstone profile is used in a region of the base and housing where strength is not required. It also has an oval extension that seats in both the vertical and folded pocket positions in the base. These base features are used in place of pins and ball/wedge and ball/spring combinations that are commonly used to perform this same function. The tombstone profile provides longer contact dimensions between the crosslock and the housing, thereby, decreasing rotation and reducing the number of parts necessary to form an optimally functioning assembly.

Another purpose of the crosslock assembly is to allow for the creation of a polymer or injection molded sight rather than a machined aluminum product, thereby, decreasing the cost of manufacture.

The base has also been specially formed to reduce the number of accessory parts needed for the assemblies. The base comprises specially configured vertical and folded pocket positions that strengthen the interaction between the base and the crosslock, thereby, providing the required strength needed to lock the assembly into position while eliminating the need for traditionally used pins. These pockets distribute the strength of the base, housing and crosslock assemblies.

In addition, when the housing is in the full vertical seated position, the tombstone profile of the crosslock projects through the housing and seats into a slot in the base. This creates a dual form of locking all three features together that has before never been maintained. These features are also conducive in replacing machined aluminum parts with plastic molded pieces while maintaining more than sufficient strength.

Additionally, the crosslock oval extension comprises a chamfer that seats with chamfers in the base pockets which additionally prevent housing rotation. In the folded position the crosslock chamfers seat with a chamfer on the base allowing the housing to be vertically positioned for sight use. The crosslock rides off the chamfered seat and the spring seats in the deep pocket on the base, locking it into position. The crosslock is depressed and the housing is returned to the folded position when not in use. These features create a self-centering condition that automatically returns the housing to a central location.

These and other features and advantages of the present invention will be more fully understood from a reading of the following detailed description.

BRIEF DESCRIPTION OF THE DRAWINGS

FIGS. 1*a* and 1*b* are schematics depicting an exploded view of an exemplary folding sight and crosslock unit comprising an exemplary folding sight assembly and an exemplary crosslock assembly;

FIGS. 16*a* and 16*b* are schematics depicting an exemplary elevation adjustment sight assembly, wherein FIG. 16*a* depicts the elevation adjustment sight assembly in a lowered position relative to the crosslock assembly (not shown), and FIG. 16*b* depicts the elevation adjustment sight assembly in a raised position relative to the crosslock assembly (not shown)

DETAILED DESCRIPTION OF THE INVENTION

The folding sight and crosslock unit of the present invention comprises a housing, a base, an aperture, and a crosslock, all of which are uniquely formed so that they may be assembled on a firearm, such as, for example, an M4/M14 rifle, in a relatively easy fashion while reducing the need for accessory components, such as ball and springs fasteners, pins, nuts and bolts, and the like, as compared with conventionally formed folding sight and crosslock assemblies.

More specifically, the housing has been uniquely configured to receive a specially designed engagement spring which secures the aperture to the housing with the assistance of a minimum number of accessory members. Additionally, the base and the housing have been structured to receive a specially configured crosslock, wherein the crosslock secures the base to the housing in such a manner that the number of accessory members is reduced. Further the configuration of the housing and the base distribute the strength of the base, housing and crosslock. Also, when the housing is in the full vertical seated position, the tombstone profile of the crosslock projects through the housing and seats into a slot in the base. This creates a unique dual form of locking all three features together. These features also allow for the replacement of machined aluminum parts with plastic molded pieces while maintaining more than sufficient strength.

Figure 1A:
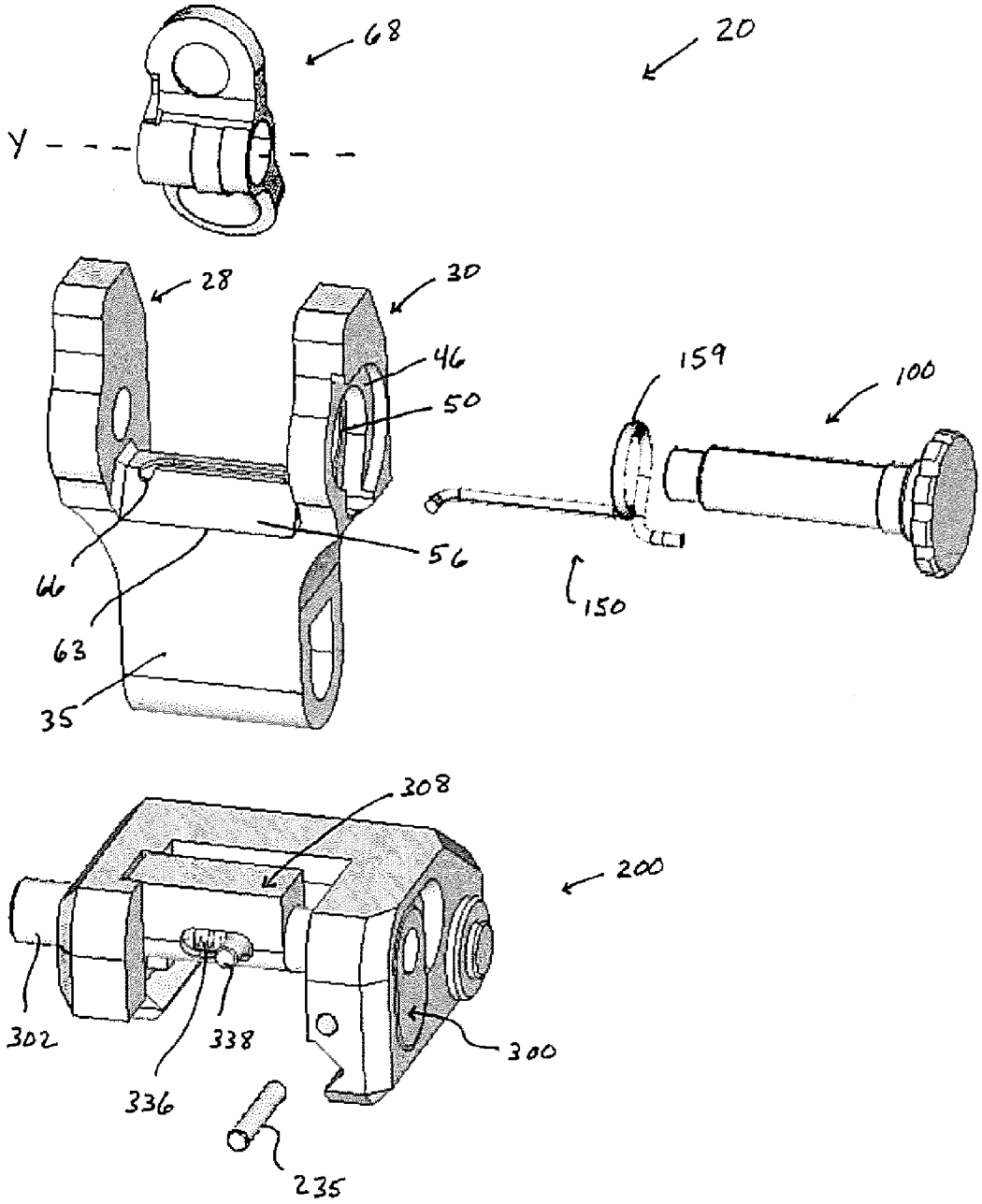
Figure 16:
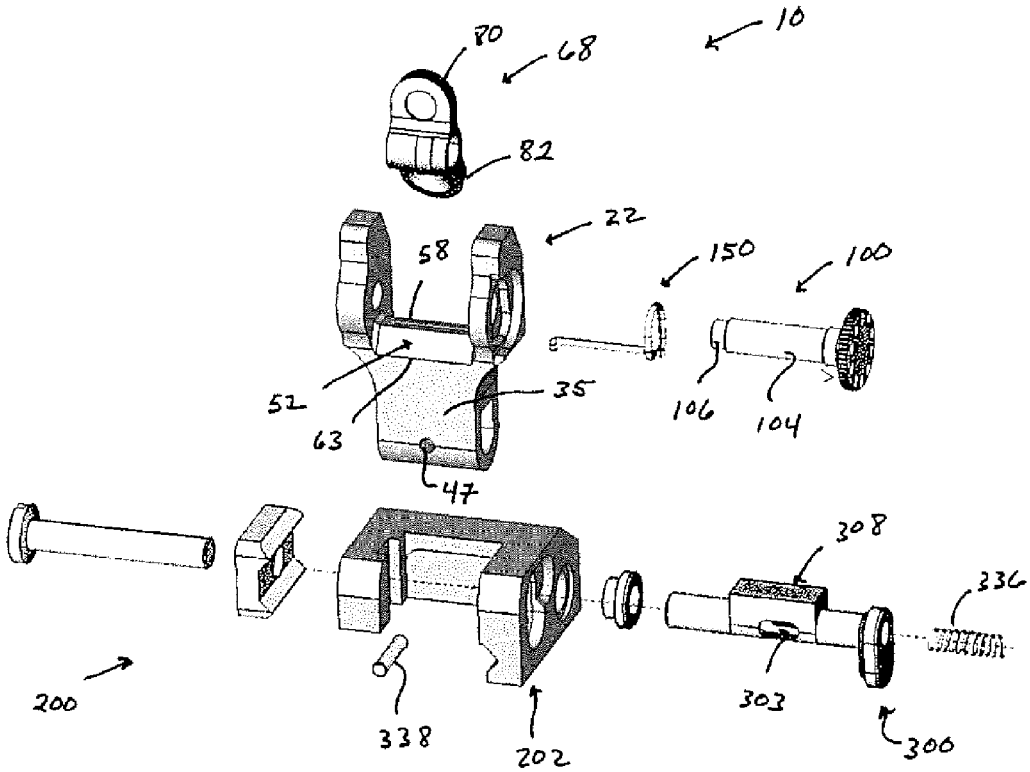

An exemplary folding sight and crosslock unit shall be described with reference to the figures, wherein it is to be understood that the figures shall in no way limit the scope of the invention. Referring to FIG. 1, an exemplary folding sight and crosslock unit 10 comprises a folding sight assembly 20 and a crosslock assembly 200. Folding sight assembly 20 comprises a housing 22, an aperture 68, a windage adjustment knob 100, and an engagement spring 150.

Figure 2:
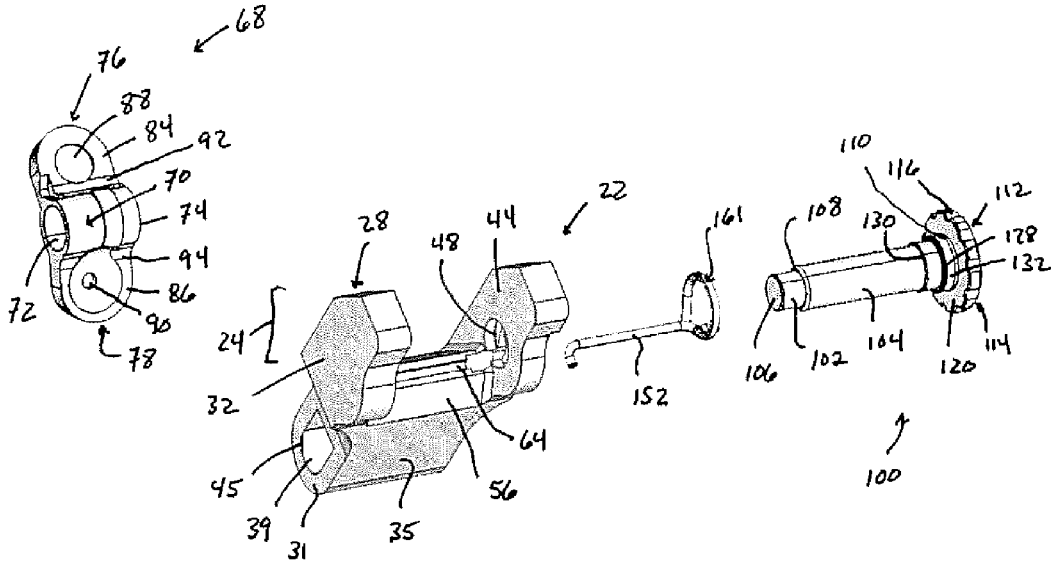
FIGS. 2 and 3 are schematics depicting exploded and opposite views of the folding sight assembly in combination with a portion of the crosslock assembly depicted in FIG. 1.
Figure 3:
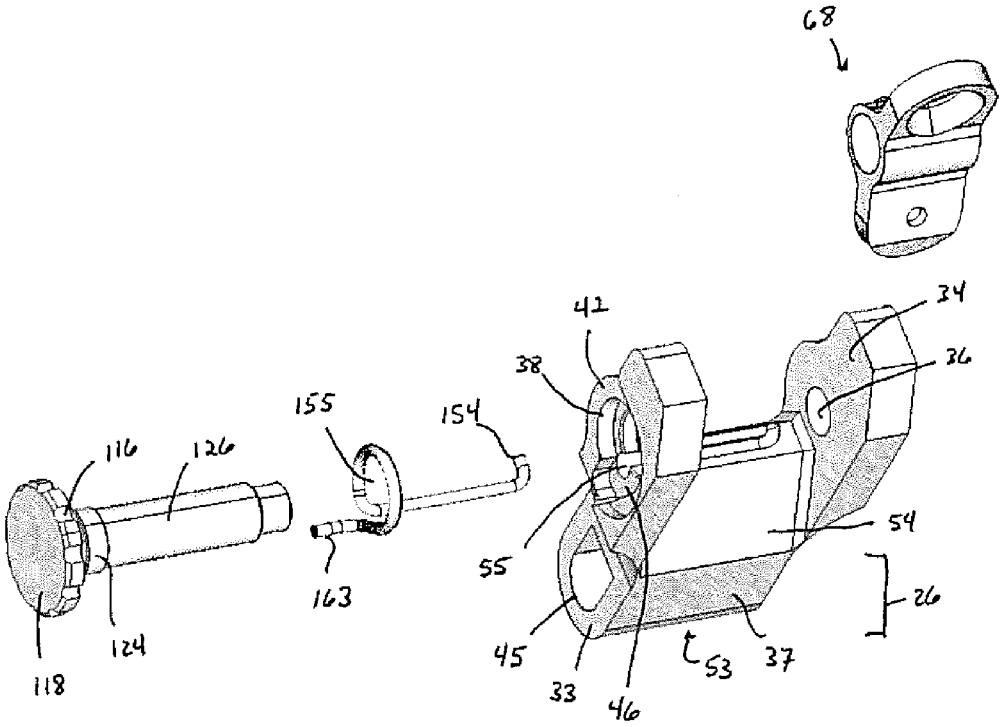

Referring to FIGS. 1-3, housing 22 comprises an upper region 24 and a lower region 26. Upper region 24 comprises a catch plate 28 oppositely situated to a windage adjustment plate 30. Catch plate 28 has an exterior-oriented side wall 32 oppositely situated to an interior-oriented side wall 34, wherein interior-oriented side wall 34 has a divot 36 formed therein.

Windage adjustment plate 30 comprises an exterior-oriented side wall 42 oppositely situated to an interior-oriented side wall 44. An opening 38 is formed through exterior-oriented side wall 42, and an opening 48 is formed through interior-oriented side wall 44 to reveal an intermediate wall 46 disposed between exterior- and interior-oriented side walls 42 and 44. An opening 50 is formed through intermediate wall 46, wherein opening 50 is in fluid communication with openings 38 and 48, and further wherein opening 50 has a smaller diameter than the diameters of either openings 38 and 48. A groove 55 extends from intermediate wall 46 to interior-oriented wall 44.

As shown in FIGS. 1-3, in an exemplary embodiment, lower region 26 comprises a body 53 having a lateral wall 31 oppositely situated to a lateral wall 33, and a proximal wall 35 oppositely situated to a distal wall 37. A channel 39 is formed between proximal wall 35 and distal wall 37 in the shape of a tombstone configuration. A hole 45 is formed through lateral walls 31 and 33, wherein hole 45 leads into channel 39. A hole 47 is formed through proximal wall 35, wherein hole 47 is in fluid communication with channel 39.

Figure 6A:
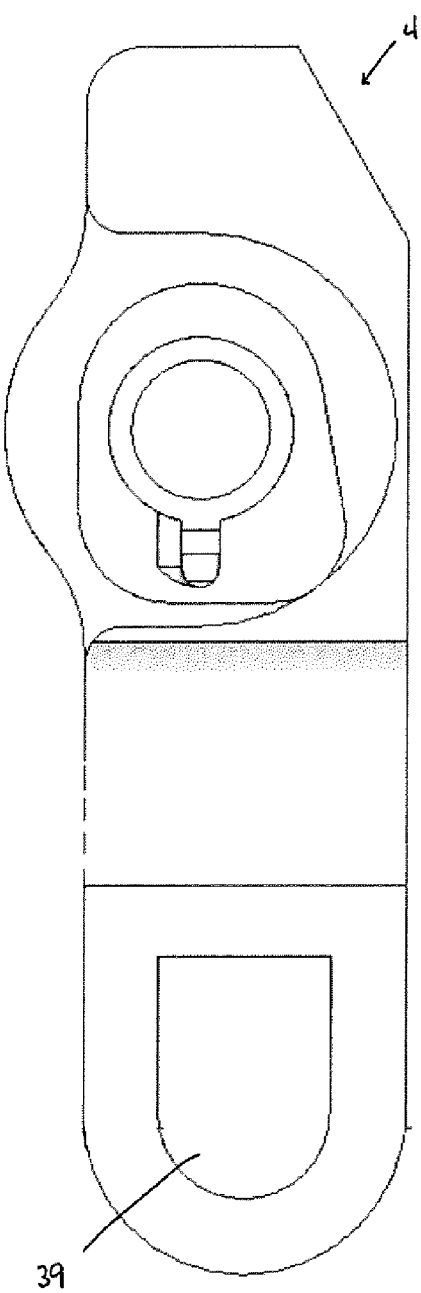
FIG. 6*a* is a schematic depicting a profile view of an exemplary housing.
Figure 6B:
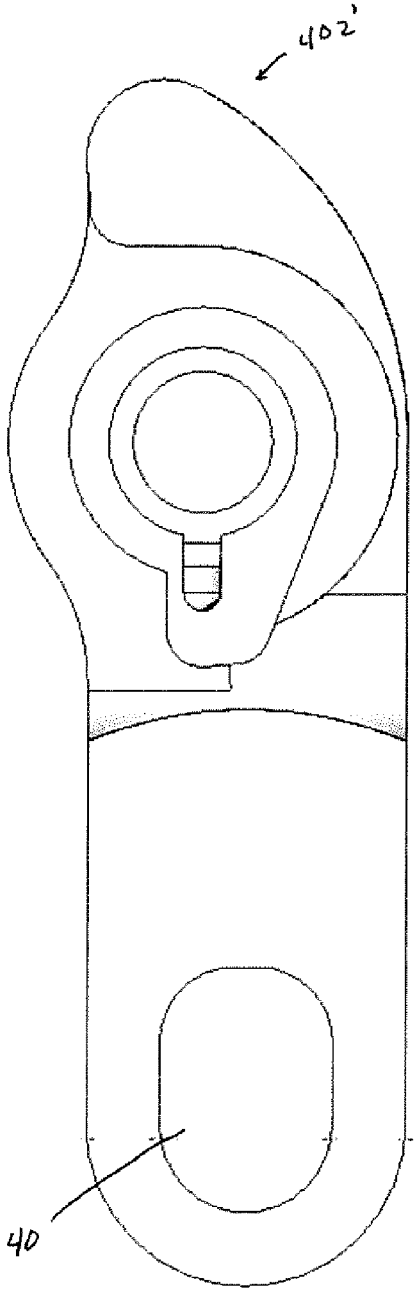
FIG. 6*b* is a schematic depicting a profile view of another exemplary housing.
Figure 7A:
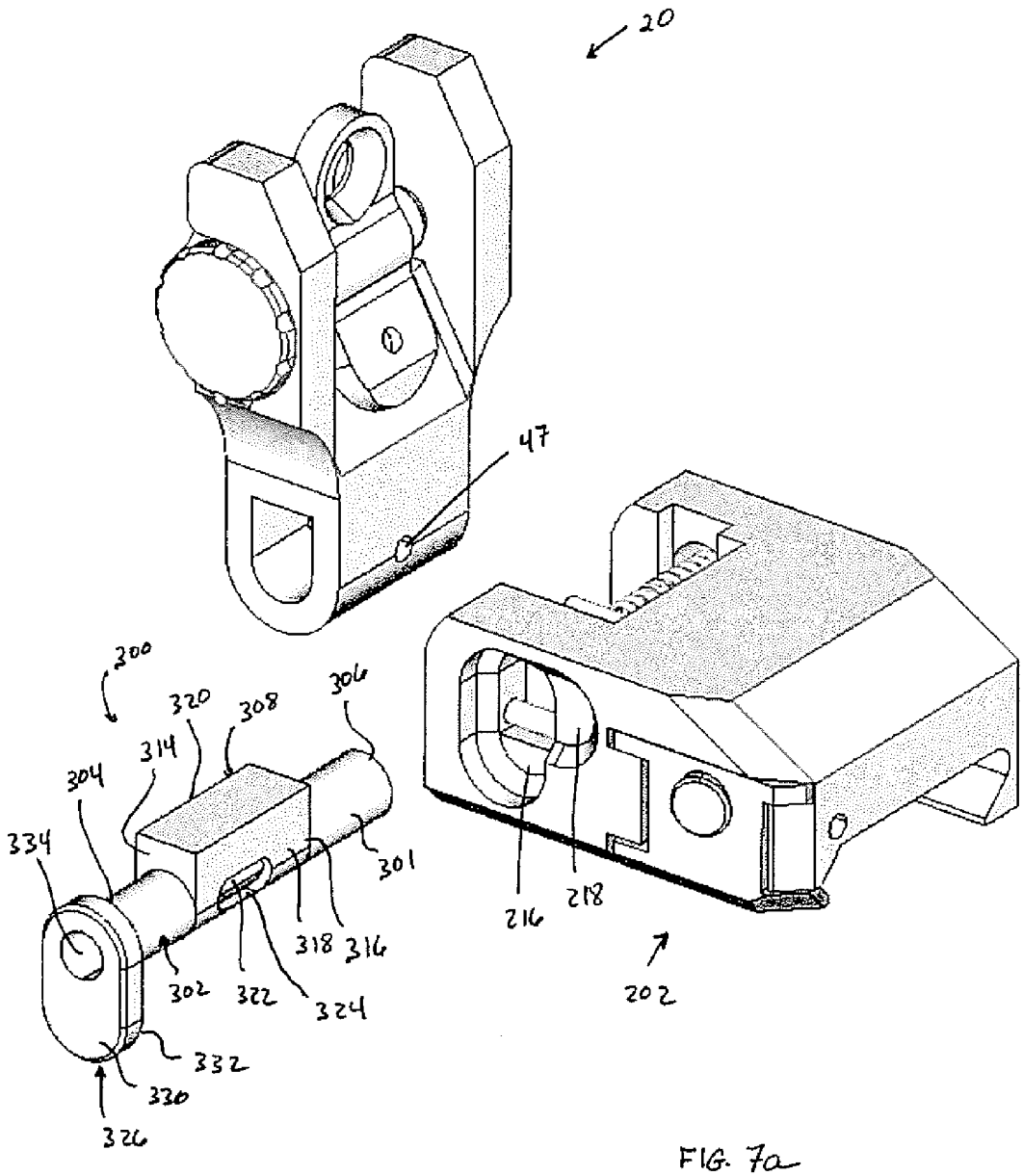
FIG. 7*a* is a schematic depicting the folding sight and crosslock unit as depicted in FIG. 1.
Figure 7B:
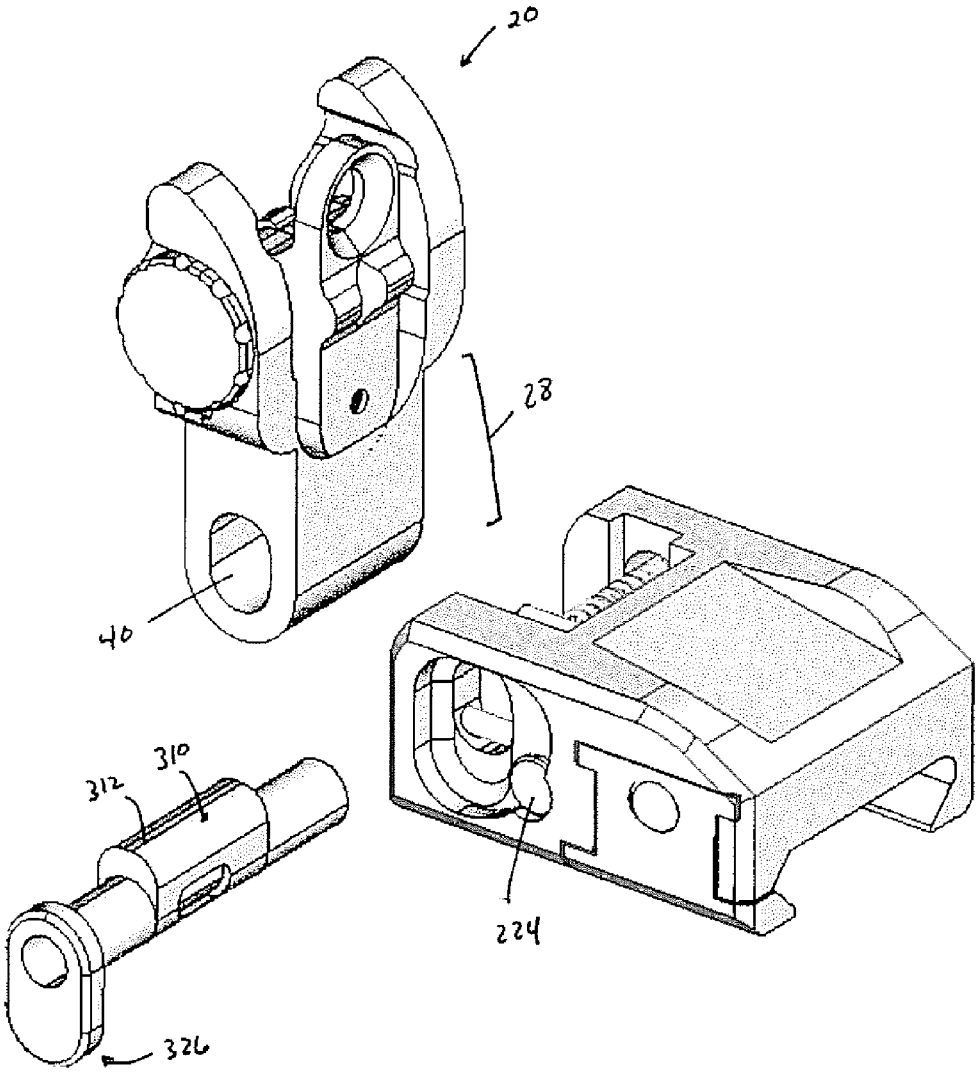
FIG. 7*b* is a schematic depicting an exemplary folding sight and crosslock depicting a housing having an exemplary embodiment.

In another exemplary embodiment, such as is shown in FIGS. 6*b* and 7*b*, a lower region 28 is substantially identical to lower region 26 except that instead of channel 39, a channel 40 is formed between proximal and distal walls 35 and 37. As shown, channel 40 and hole 45 have a substantially oval-shaped configuration.

Referring again to FIGS. 1-3, housing 22 further comprises a bridge member 52. Bridge member 52 comprises a side wall 54 oppositely situated to a side wall 56, and a top side 58 opposite to a bottom side 63. Top side 58 has a first terminal end oppositely situated from a second terminal end, wherein a groove 64, which is coterminous with groove 55 of windage adjustment plate 30, extends from the first terminal end and extends along top side 58 where it bends towards side wall 56 and forms a detent 66 in side wall 56.

Aperture 68 comprises a hollow cylindrical body 70 having a first open end 72 oppositely situated to a second open end 74, wherein a longitudinal axis Y runs through open ends 72 and 74. Extending from body 70 is an ocular plate 76 and an ocular plate 78, wherein each of ocular plates 76 and 78 respectively comprises a top side 80 and 82 oppositely situated to a bottom side 84 and 86, wherein a respective hole 88 and 90 is formed through top sides 80 and 82 and bottom sides 84 and 86. A groove 92 is formed along bottom side 84 of ocular plate 76 and a groove 94 is formed along bottom side 86 of ocular plate 78, wherein grooves 92 and 94 extend parallel with longitudinal axis Y.

Windage adjustment knob 100 comprises a protrusion 102 which extends from a proximal terminal end 108 of a shaft 104 to expose a bottom wall 106 of protrusion 102. Centrally disposed atop a distal terminal end 110 of shaft 104 is a head 112. Head 112 comprises a substantially disc-shaped body 114 having a plurality of ridges and grooves 116 formed around an outer edge thereof. Body 114 further comprises a front face 118 oppositely situated to a back face 120, wherein a plurality of grooves 122 are formed on back face 120.

Windage adjustment knob 100 further comprises an annular ring 124 disposed around an exterior wall 126 of shaft 104 towards distal terminal end 110 of shaft 104. Annular ring 124 comprises a top edge 128 opposite to a bottom edge 130, wherein top edge 128 is directed towards head 112 and bottom edge 130 is directed towards bottom wall 106 of protrusion 102. A region 132 of exterior wall 126 of shaft 104 is exposed between top edge 128 and back face 120 of head 112, wherein region 132 is recessed relative to top edge 128 of annular ring 124.

Engagement spring 150 comprises a longitudinally extending body 152. At one end of body 152, body 152 bends approximately 90 degrees to form a retaining hook portion 154. At an opposite end thereof, body 152 turns to form a retaining loop portion 161, which has a substantially annular shaped configuration. An apex 159 of retaining loop portion 161 extends approximately 90 degrees from body 152. Retaining loop portion 161 has an opening 155 centrally formed therethrough. A terminal end of retaining loop portion 161 extends past body 152 and bends approximately 90 degrees therefrom in a direction opposite to body 152 to from a windage adjustment knob lock 163.

When folding sight assembly 20 is assembled, body 152 of engagement spring 150 is engaged with groove 64 of bridge member 52 and retaining hook portion 154 of engagement spring 150 is engaged with detent 66 of bridge member 52. Additionally, windage adjustment knob 100 is disposed through hollow cylindrical body 70 of aperture 68 such that bottom wall 106 of protrusion 102 abuts catch plate 28 and head 112 of windage adjustment knob 100 extends from exterior-oriented wall 42 of windage adjustment plate 30. Additionally, windage adjustment knob lock 163 is positioned within one of the grooves from plurality of grooves 122, and retaining loop portion 161 rests on region 132 of shaft 104 of windage adjustment knob 100. Ocular plates 76 and 78 of aperture 68 may be adjusted by rotating the plates in either a clockwise or counterclockwise direction, wherein respective grooves 92 and 94 may receive body 152 of engagement spring 150.

Figure 4:
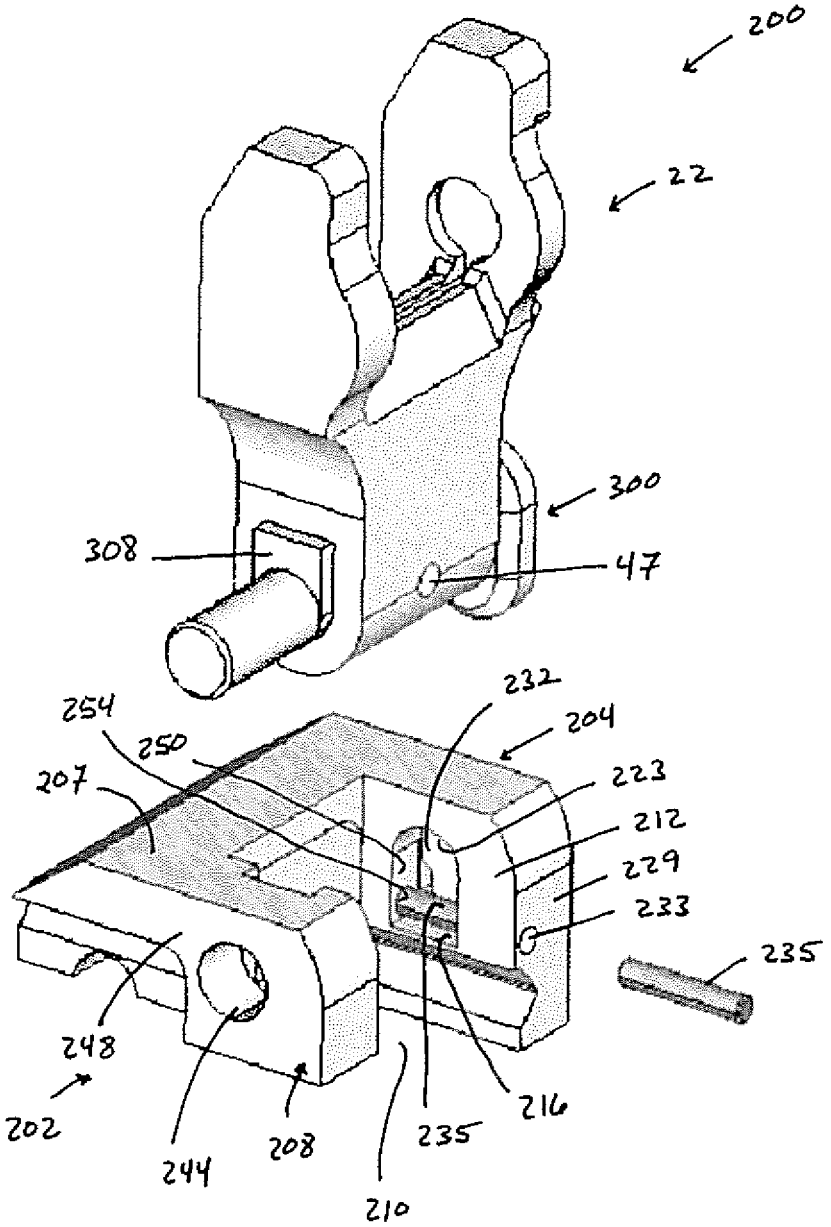
FIGS. 4 and 5 are schematics depicting opposite views of the crosslock assembly in combination with a portion of the folding sight assembly depicted in FIG. 1.
Figure 5:
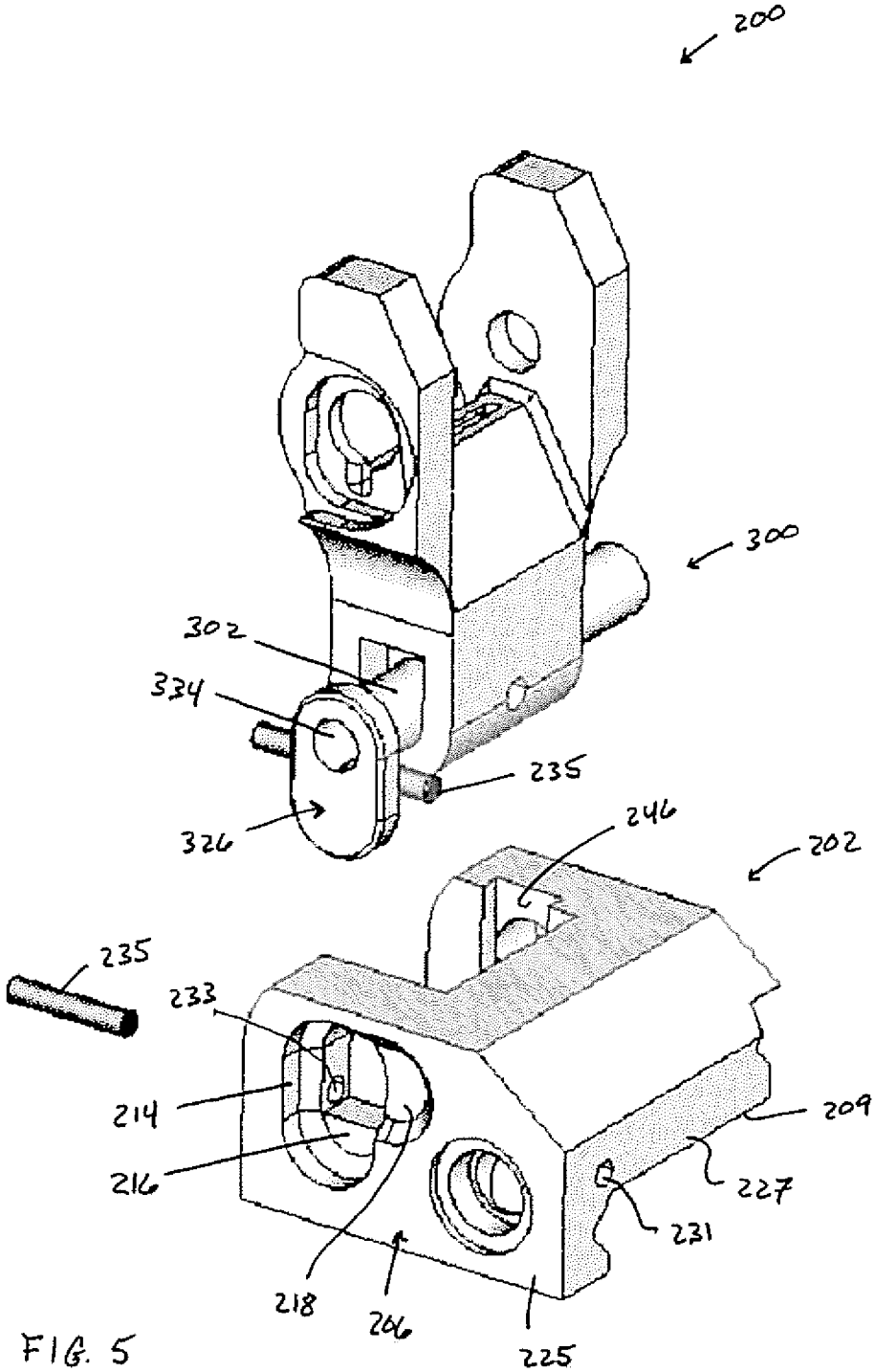

An exemplary crosslock assembly shall now be described with reference to the figures. Referring to FIGS. 4 and 5. Here, crosslock assembly 200 comprises a base 202 and a crosslock 300.

Base 202 comprises a body 204 having a distal wall 206 oppositely situated to a proximal wall 208, a top side 207 oppositely situated to a bottom side 209, and an anterior wall 227 oppositely situated to an open-ended posterior wall 229. A chamber 210 is formed between proximal and distal walls 206 and 208, top and bottom sides 207 and 209, and anterior and posterior walls 227 and 229. Holes 231 and 233 are respectively formed through anterior and posterior walls 227 and 229.

Proximal wall 208 comprises an opening 244 formed through an interior wall 246 and an exterior wall 248 thereof. Distal wall 206 comprises an exterior wall 225 oppositely situated to an interior wall 212. An opening 214 is formed through exterior wall 225 and extends to a first abutment wall 216 formed between exterior and interior walls 225 and 212 to form a deep pocket within base 202. In an exemplary embodiment, opening 214 is substantially oval shaped, and is defined by chamfered walls.

An indentation is formed within exterior wall 225 to reveal a second abutment wall 218 which is raised relative to first abutment wall 216, i.e., positioned closer to top side 207 than is first abutment wall 216, and which is positioned closer to exterior wall 225 than it is to interior wall 212. Second abutment wall 218 defines a shallow pocket which overlaps and transects the deep pocket. In an exemplary embodiment, the shallow pocket is substantially oval in shape and is defined by chamfered walls. Alternatively, or additionally, an insert 224 (see FIG. 7*b*) may be positioned on second abutment wall 218 to replace the function of a chamfered wall.

Interior wall 212 comprises a tombstone-shaped channel 232 formed therethrough, wherein chamber 232 is in fluid communication with the deep and shallow pockets, and further wherein first abutment wall 216 forms the lowermost border of chamber 232, and an interior directed concave shaped wall 223 forms the uppermost border of chamber 232. A hole 254 is formed through an anterior directed interior side wall 250 which defines in part channel 232 of the shallow pocket. Hole 254 and hole 231 are in fluid communication with one another via a channel (not shown).

As best shown in FIG. 7*a*, crosslock 300 comprises a shaft 302. Shaft 302 comprises a longitudinally extending generally cylindrical-shaped body 301, an open-ended proximal side 304 formed on a terminal end of body 301, and a distal side 306, which is formed on an oppositely situated terminal end of body 301. A longitudinally extending chamber is formed through body 301 and extends to and from proximal and distal sides 304 and 306. A hole 303, which is in fluid communication with the chamber of shaft 302, is formed through body 301.

Disposed over hole 303 of shaft 302 is a support member 308. Although support member 308 is depicted as having a generally U-shaped configuration in FIG. 7*a* and a generally rectangular-shaped configuration in FIG. 7*b*, the shape of the support member is not to be limited to the foregoing, but may take on a variety of shapes so long as the support member achieves the purposes of the support member as shall be more specifically described herein.

Referring primarily to FIGS. 7*a* and 7*b*, support member 308 comprises a body 310 having a top side 312, a proximal side 314, a distal side 316, a lateral side 318, and a lateral side 320. A channel 322 is formed between top side 312, proximal side 314, distal side 316, lateral side 318, and lateral side 320. An opening 324 is formed through lateral side 318, wherein opening 324 is aligned with hole 303 of shaft 302 and is in fluid communication with channel 322.

Crosslock 300 further comprises a handle member 326. Handle member 326 comprises a body having a front side 330 oppositely situated to a back side 332, wherein back side 332 is disposed on proximal end 304 of shaft 302. Additionally, a hole 334 is formed through front and back sides 330 and 332 above a midline thereof, wherein hole 334 is aligned with and in fluid communication with channel 322 of shaft 302.

As shown in FIGS. 1, 4, and 5, when assembled, lower region 26 of housing 22 is positioned within chamber 210 of base 202 such that proximal wall 35 of housing 22 is directed towards proximal wall 208 of base 202, and distal wall 37 of housing 22 is oriented towards distal wall 206 of base 202. Shaft 302 of crosslock 300 is disposed through opening 244 of base 202, through chamber 232 of base 202, and through channel 39 of housing 22 such that support member 308 is disposed through channel 39 of housing 22, and such that distal side 316 of support member 308 physically abuts interior wall 246 of proximal wall 208 of base 202. Distal end 306 of shaft 302 extends through opening 244 on proximal wall 208 of base 202, while back side 332 of handle member 326 is adjacent to exterior wall 225. A rod 235 is disposed through holes 231, 254, and 233 respectively formed on base 202 of crosslock assembly 200. Rod 235 forces crosslock 300 to rotate around its central axis, and prevents downward movement of crosslock 300.

Figure 8A:
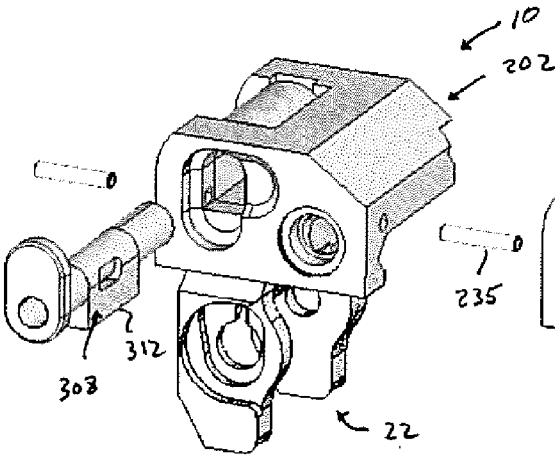
FIGS. 8*a*-8*e* are schematics depicting an exemplary movement of the components of the folding sight and crosslock unit relative to one another.
Figure 8B:
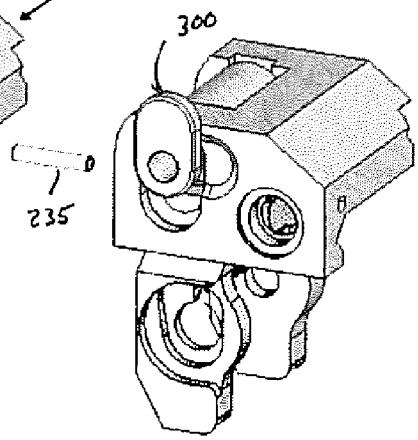
Figure 8C:
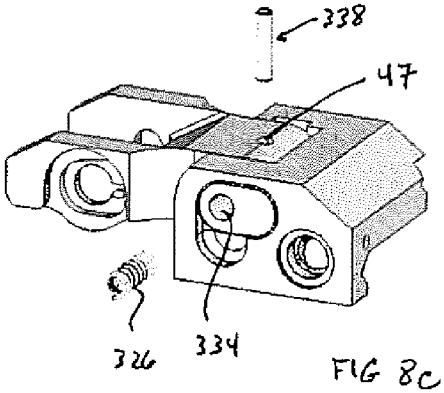
Figure 8D:
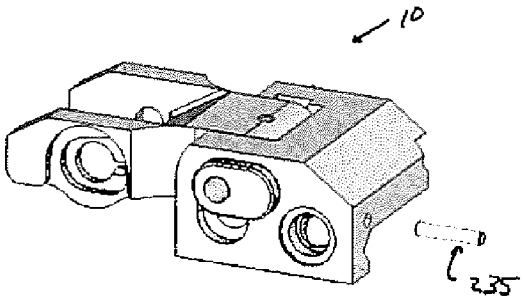
Figure 8E:
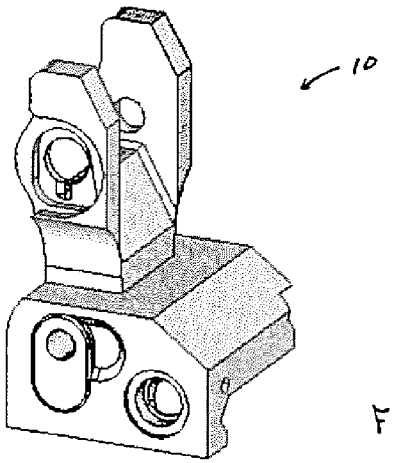

FIGS. 8*a*-8*e* depict movement between crosslock assembly 200 and housing 22. As shown in FIG. 8*a*, housing 22 is in the folded down position relative to base 202. As shown in FIG. 8*b*, crosslock 300 is inserted through the deep pocket such that support member 308 is disposed through and contained within channel 39. Rod 235 is disposed through holes 231, 254, and 233 and blocks downward movement of shaft 302. Referring to FIG. 8*c*, an upward directed force is applied to housing 22 causing housing 22 to pivot approximately 90 degrees relative to base 202 to cause handle member 326 to sit within the shallow pocket. A crosslock spring 336 is inserted through hole 334 and into chamber 311 of shaft 302, and a pin 338 is inserted through hole 47 of housing 22 and through opening 324 of support member 308 and hole 303 of shaft 302. Crosslock spring 336 is compressed by pin 338 to provide housing 22 with a limited range of motion relative to base 202. Referring to FIG. 8*e*, housing 22 may be manually pushed into a vertical position for sight use. Crosslock 300 rides off of chamfers 226 and crosslock spring 336 seats it in deep pocket 220, locking it at the vertical position. Rod 235 may then be inserted through holes 231, 254, and 233. Crosslock 300 may then be depressed and housing 22 may be returned to the folded position.

Figure 9:
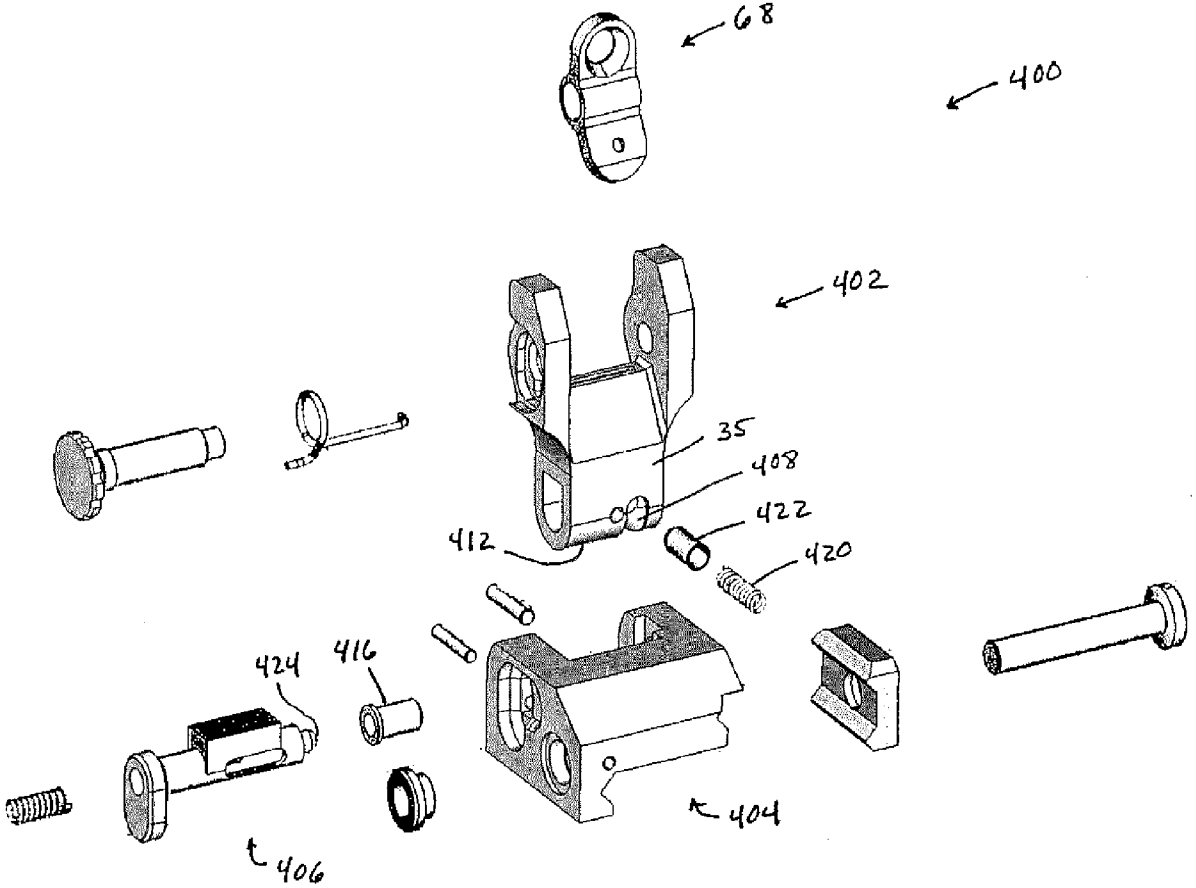
FIG. 9 is a schematic depicting an exploded view of another exemplary folding sight and crosslock unit.

Another exemplary crosslock assembly 401 is depicted in FIG. 9, wherein crosslock assembly 401 may be combined with folding sight assembly 200 and/or with elevation adjustment sight assembly 501 as later described herein. Crosslock assembly 401 is essentially identical to crosslock assembly 200 except that instead of housing 22 being manually raised by a user from the folded to the vertical positions, a push button is used to position the housing in a folded and a vertical position. At least two major benefits are achieved by modifying crosslock 300 with a push button function that uses, e.g., a spring loaded shell: (1) the amount of material that is removed from the crosslock is minimized; and (2) the strength of the crosslock is maximized for the production of plastic mold injection sights.

Referring to FIG. 9, an exemplary folding sight and crosslock unit 400 comprises a housing 402, a base 404, and a crosslock 406. Housing 402 is essentially identical to housing 22 except that a shell contact groove 408 is formed through proximal wall 35 and a bottom side 412 of body 53 of housing 402.

Crosslock 406 is essentially identical to crosslock 300 except that crosslock 406 further has a non-rotating pushbutton 416 disposed on distal end 306 of shaft 302. A spring loaded shell 418, comprising a spring 420 disposed within a shell 422, is disposed through shell contact groove 408 located on housing 402 where it makes contact with a terminal end of crosslock 406.

Figure 11:
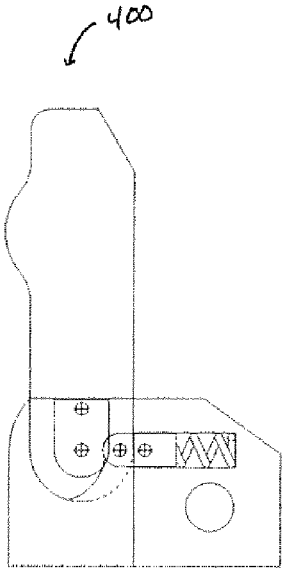
FIG. 11 is a schematic depicting the folding sight and crosslock unit depicted in FIG. 9, wherein the housing is in a vertical position.
Figure 12A:
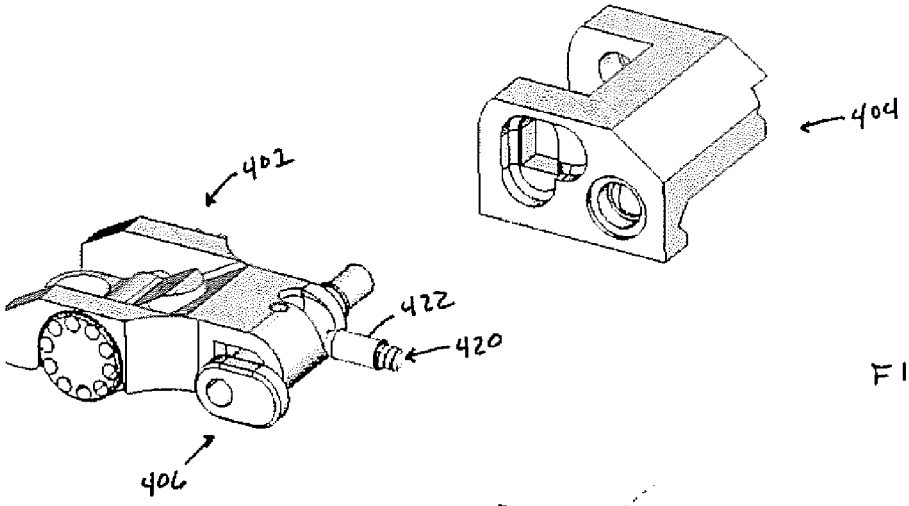
FIGS. 12*a*-12*c* are schematics depicting the folding sight and crosslock unit of FIG. 9.
Figure 12B:
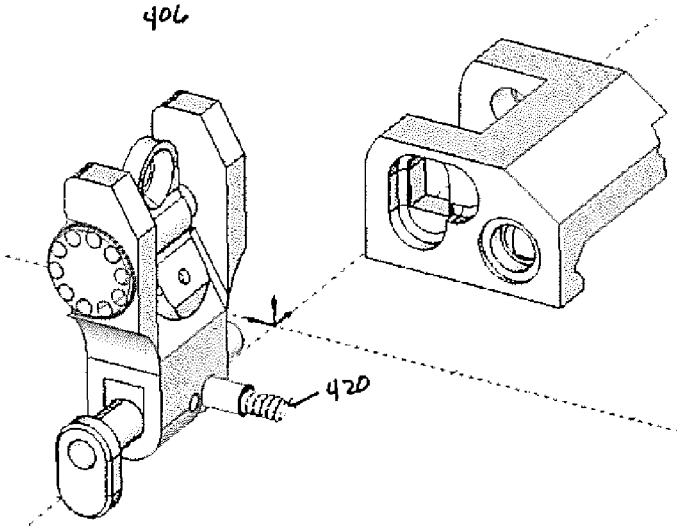
Figure 12C:
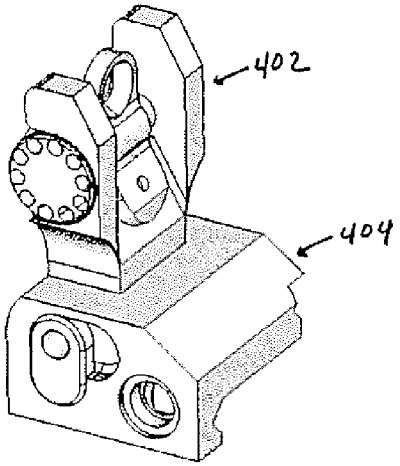

FIGS. 12*a*-12*c* depict an exemplary movement of folding sight and crosslock unit 400. FIG. 12*a* depicts crosslock assembly 401 at a fully seated folded position, wherein spring loaded shell 446 is at full compression (see also FIG. 10). FIG. 12*b* depicts crosslock assembly 401 when pushbutton 442 is depressed causing spring loaded shell 446 into a vertical position. When pushbutton 442 is released, crosslock assembly 401 is fully seated at a vertical position as shown in FIG. 12*c* (see also FIG. 11).

Figure 10:
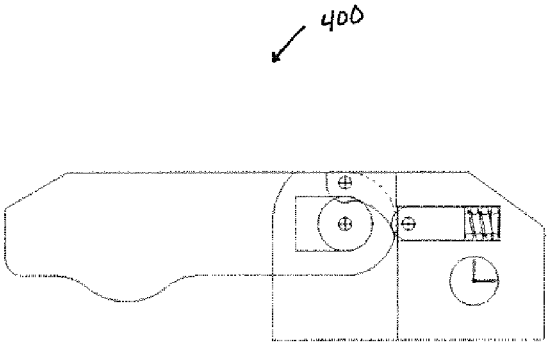
FIG. 10 is a schematic depicting the folding sight and crosslock unit depicted in FIG. 9, wherein the housing is in a folded down position.

FIG. 10 shows a decreasing radius that contacts spring loaded shell 446. When pushbutton 442 is depressed, spring loaded shell 446 extends. At this point, crosslock 406 is in an "unlocked" condition, and housing 402, due to the force of spring loaded shell 446, is free to rotate to its vertical position as shown in FIG. 11.

Figure 13:
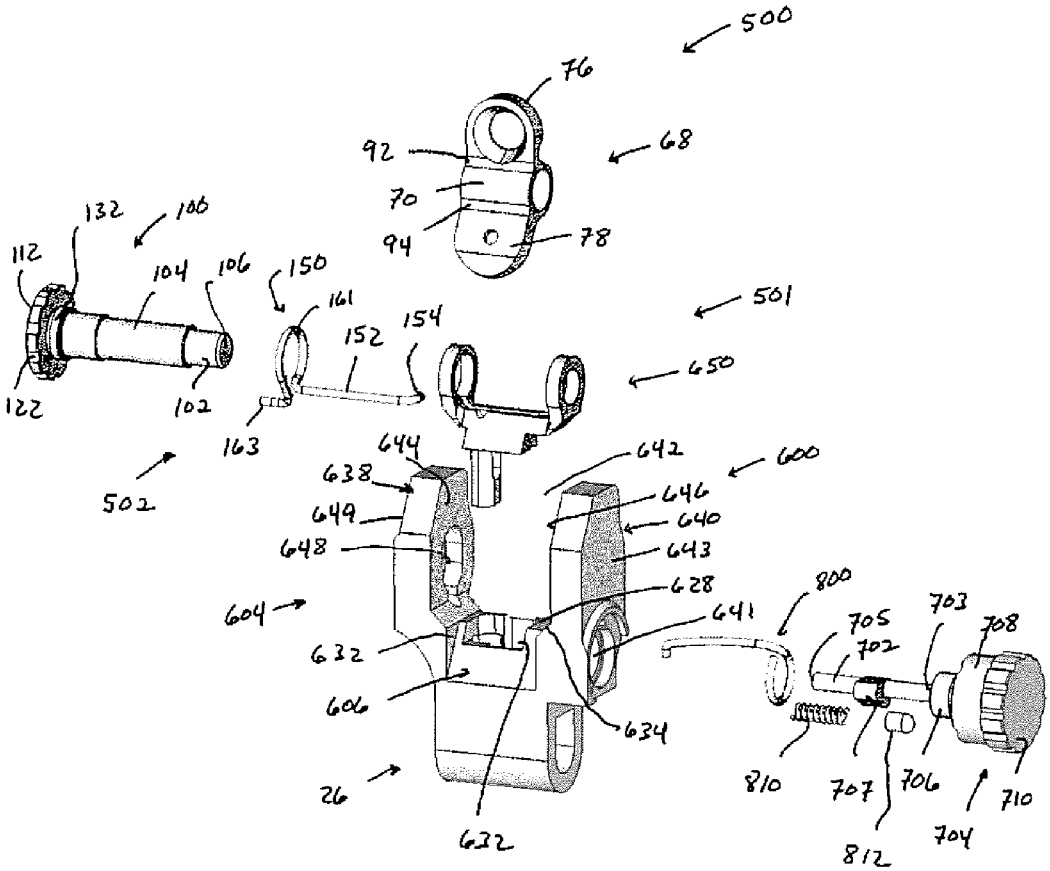
FIG. 13 is a schematic depicting an exemplary elevation adjustment sight and crosslock unit comprising an elevation adjustment sight assembly and a crosslock assembly.
Figure 14:
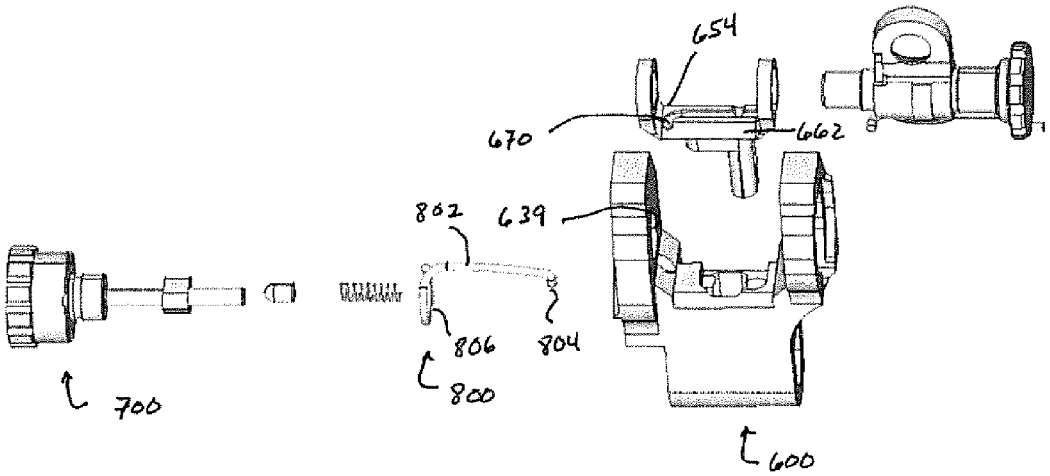
FIGS. 14 and 15 are schematics depicting opposite views of the elevation adjustment sight and crosslock unit depicted in FIG. 13.
Figure 15:
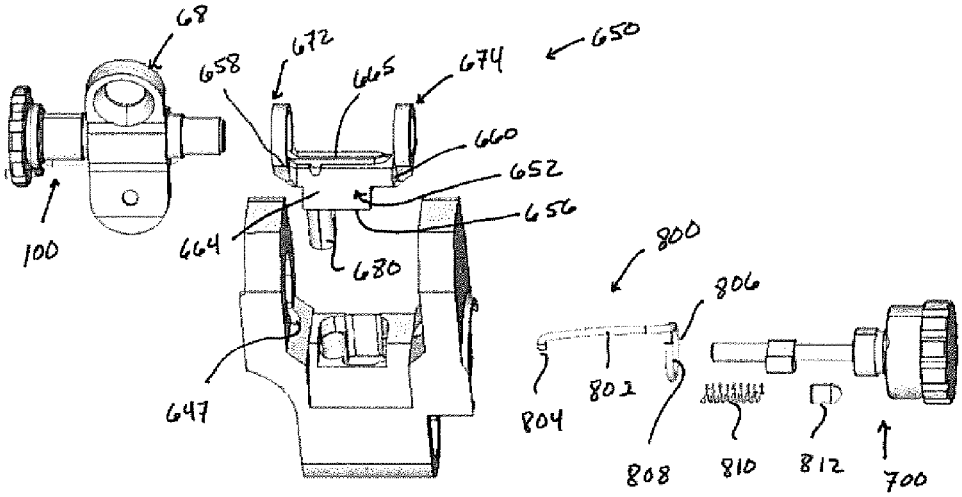

Further disclosed herein is an elevation adjustment sight and crosslock unit which allows for the elevation adjustment sight for sighting and targeting at ranges over various distances. An exemplary elevation adjustment sight and crosslock unit 500 is depicted in FIGS. 13-15. Elevation adjustment sight and crosslock unit 500 comprises an elevation adjustment sight assembly 501 and crosslock assembly 200 as described above-herein with reference to folding sight and crosslock unit 10. Elevation adjustment sight assembly 501 comprises a spring subassembly 502, a housing 600, a windage carrier 650, a lift dial 700, and a lift spring 800.

Spring assembly 502 comprises aperture 68, windage adjustment knob 100, and engagement spring 150, all as described above with reference to FIGS. 1-3.

Housing 600 comprises a lower region 26 or a lower region 28 as described above with reference to folding sight and crosslock unit 10, where, again the geometrical configuration of the opening in lower region 26 and 28 is not limited by the drawings provided for herein. Crosslock assembly 200 may be physically engaged with lower region 26 or 28 in substantially the same manner as described with reference to folding sight and crosslock unit 10.

Referring to FIGS. 13-16*b*, housing 600 further comprises an upper region 604. Upper region 604 comprises a frame 606 that is contiguously formed with lower region 26. Frame 606 further comprises a top side 628 oppositely situated to lower region 26. Top side 628 has an opening 630 formed therethrough, wherein opening 630 leads into a chamber 632. Frame 606 further has an anterior side 634 oppositely situated to a posterior side 636.

A windage adjustment plate 638 extends from anterior side 634 of frame 606 and a catch plate 640 extends from posterior side 636 of frame 606 such that a space 642 is created between interior directed walls 644 and 646 of respective plates 638 and 640 and top side 628 of frame 606.

Windage adjustment plate 638 has an opening 648 formed through an exterior directed wall 649 thereof and interior directed wall 644, while catch plate 640 has an opening 641 formed through an exterior directed wall 643 thereof and interior directed wall 646. A divot 647 is formed on interior directed wall 644 of windage adjustment plate 638, and is in fluid communication with opening 648. Interior directed wall 646 of catch plate 640 has a groove 639 formed therein.

Windage carrier 650 comprises a body 652 having a top wall 654 opposite to a bottom wall 656, an anterior wall 658 oppositely situated to a posterior wall 660, and a proximal wall 662 oppositely situated to a distal wall 664. Top wall 654 has a channel 665 formed therein, wherein channel 665 leads into a chamber 661. A detent 670, which is coterminously formed with channel 665, is formed on proximal wall 662 of body 652, while an opening 663 is formed on distal wall 664 of body 652.

An anterior directed extension member 672, having a generally annular shaped configuration, is coterminously formed with anterior wall 658, and a posterior directed extension member 674, having a generally annular shaped configuration, is coterminously formed with posterior wall 660. Each of members 672 and 674 has an opening 676 and 678 respectively formed therein, wherein openings 676 and 678 are in fluid communication with the channel formed in body 652.

Windage carrier 650 further comprises a protrusion 680 which extends substantially perpendicularly from bottom wall 656 of body 652. A hole 682 is formed through protrusion 680.

When properly positioned for use, protrusion 680 is seated within chamber 632 of frame 606, opening 676 of anterior directed extension member 672 is aligned with opening 648 of windage adjustment plate 638, opening 678 of posterior directed extension member 674 is aligned with groove 639 of catch plate 640, and divot 647 of windage adjustment plate 638 is aligned with channel 665 of windage carrier 650.

Additionally, body 152 of engagement spring 150 is disposed within chamber 661, retaining hook portion 154 of engagement spring 150 is engaged with detent 670 of windage carrier 650, and retaining hook portion 804 is engaged with opening 663. Shaft 104 of windage adjustment knob 100 is disposed through hollow cylindrical body 70 of aperture 68 such that bottom wall 106 of protrusion 102 of windage adjustment knob 100 abuts groove 639 of interior directed wall 646 of catch plate 640, and head 112 of windage adjustment knob 100 extends from exterior-oriented wall 649 of windage adjustment plate 638. Additionally, windage adjustment knob lock 163 of engagement spring 150 is positioned within one of the grooves from plurality of grooves 122 formed in head 112 of windage adjustment knob 100, and retaining loop portion 161 rests on region 132 of shaft 104 of windage adjustment knob 100. Ocular plates 76 and 78 may be adjusted by rotating the plates in either a clockwise or counterclockwise direction, wherein respective grooves 92 and 94 may receive body 152 of engagement spring 150.

Lift dial 700 comprises a shaft 702 having an anterior end 703 oppositely situated to a posterior end 705, wherein anterior end 703 extends from a cap member 704. Shaft 702 has a cam 707 formed around an exterior surface thereof.

Cap member 704 comprises a collar 706, a base 708, and a face 710. Collar 706 is contiguously formed with anterior end 703 of shaft 702 on one end thereof, and includes a recessed portion 712 formed on an opposite end thereof. Base 708 comprises a bottom side 714 oppositely formed with a top side 716, wherein bottom side 714 is contiguously formed with recessed portion 712 of collar 706. Bottom side 714 has a plurality of grooves 718 formed therein. Face 710 is contiguously formed with top side 716 of base 708.

Lift spring 800 comprises a substantially linear body 802. At a terminal end thereof, body 802 bends substantially perpendicularly to form a retaining hook portion 804. At an oppositely situated terminal end thereof, a substantially annular-shaped member 806 is contiguously formed with body 802. An opening 808 is centrally formed through substantially annular-shaped member 806.

When properly assembled for use, shaft 702 of lift dial 700 is inserted through opening 808 of lift spring 800 such that substantially annular-shaped member 806 is engaged with recessed portion 712 of cap member 704 of lift dial 700, and such that retaining hook portion 804 is disposed through opening 663 and extends into chamber 661 thereby securing securing retaining hook portion to windage carrier 650.

Elevation adjustment sight and crosslock unit 500 further comprises a spring 810 attached to a ball 812, wherein ball 812 is received within one of grooves 718 of cap member 704 of lift dial 700. When lift dial 700 is positioned within housing 600, ball 812 and spring 810 provide a compressive force which assists in securing elevation adjustment sight assembly 501 over a variety of distances, such as, for example in the 300, 400, 500, and 500 meter range. As lift dial 700 is rotated, body 802 of lift spring 800 flexes to retain vertical position. Retaining hook portion 804 locks lift dial 700 to windage carrier 650 to prevent removal of windage carrier 650 from housing 600.

Figure 16A:
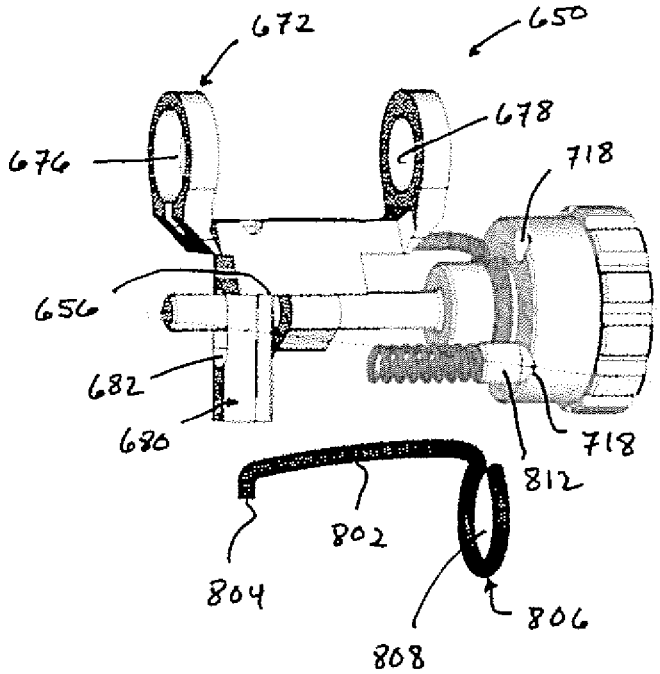
Figure 16B:
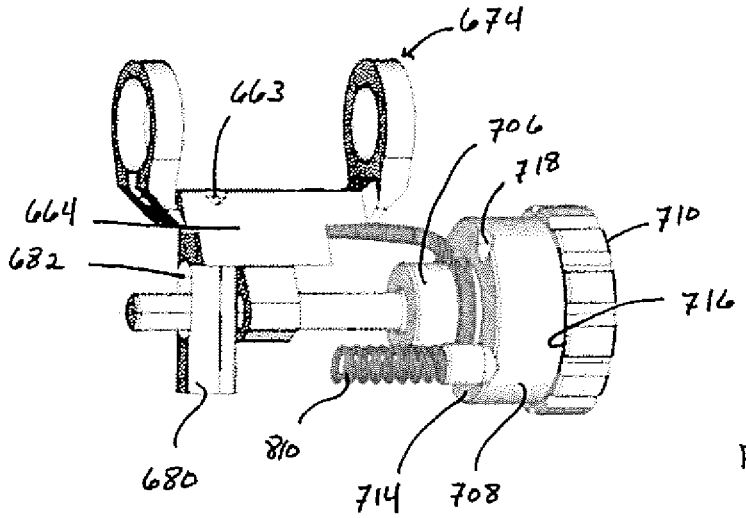
Figure 17:
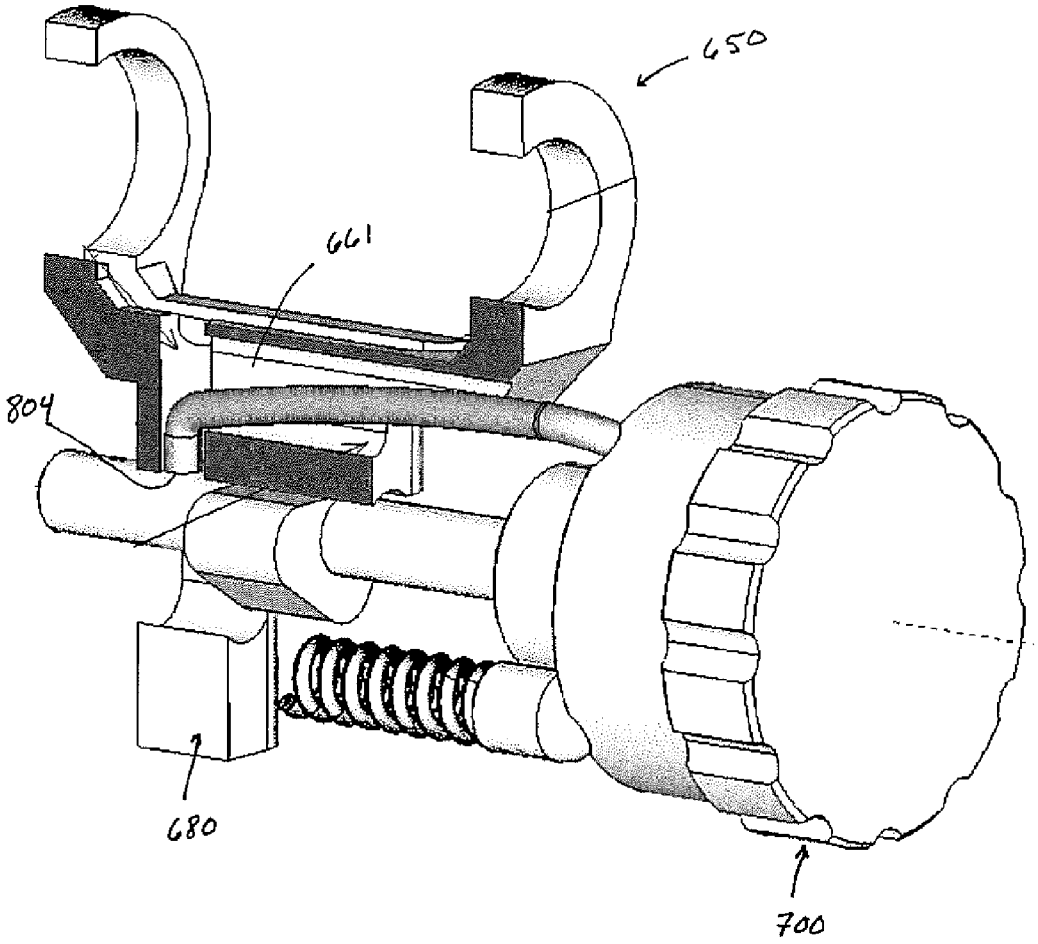
FIG. 17 is a schematic depicting a sectional view of an exemplary windage carrier and the position of the windage carrier in relation to an exemplary lift spring and an exemplary lift dial.

Referring to FIGS. 16*a*-16*b* and FIG. 17, cam 707 of lift dial 700 contacts protrusion 680 of windage carrier 650. Posterior end 705 of shaft 702 of lift dial 700 locates through hole 682 of protrusion 628 of windage carrier 650, thereby preventing windage carrier 650 from being removed from housing 600. The flex of spring 806 forces the return motion of windage carrier 650 and ensures constant contact with cam 707.

While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A folding sight assembly, comprising:

a housing having a lower region that is configured to hold a crosslock, and an upper region comprising:

a catch plate;

a windage adjustment plate having an opening formed therethrough; and a space formed between the catch plate and the windage adjustment plate;

a windage adjustment knob having a longitudinally extending shaft having a first terminal end oppositely situated from a second terminal end; and an engagement spring comprising a longitudinally extending body having a first terminal end and a second terminal end, wherein the second terminal end of the engagement spring turns to form a retaining loop portion comprising an arcuate-shaped member having an opening formed therethrough;

wherein the shaft of the windage adjustment knob is disposed through the opening of the windage adjustment plate and through the opening of the retaining loop portion of the engagement spring, and the longitudinally extending body of the engagement spring is disposed between the space formed between the catch plate and the windage adjustment plate.

2. The folding sight assembly of claim 1, wherein the housing further comprises a bridge member disposed within the space formed between the catch plate and the windage adjustment plate, wherein the bridge member has a top side having a channel formed therein, and wherein the longitudinally extending body of the engagement spring is positioned over the channel of the bridge member.

3. The folding sight assembly of claim 2, wherein the assembly further comprises an aperture, wherein the aperture comprises:

a generally cylindrical shaped body having a channel centrally formed therethrough, wherein the body of the aperture is disposed between the catch plate and the windage adjustment plate;

a first ocular plate disposed on an exterior side of the body of the aperture, wherein the first ocular plate has a groove formed thereon; and a second ocular plate disposed on the exterior side of the body of the aperture, wherein the second ocular plate has a groove formed thereon.

4. The folding sight assembly of claim 3, wherein the shaft of the windage adjustment knob is disposed through the channel of the body of the aperture, and wherein the first and second ocular plates are rotatable in relation to the bridge such that the groove of the first ocular plate is engaged with the longitudinally extending portion of the engagement spring in a first position, and the groove of the second ocular plate is engaged with the longitudinally extending portion of the engagement spring in a second position.

5. The folding sight assembly of claim 4, wherein the channel of the bridge member turns laterally away from the top side of the bridge member to form a detent in a lateral side of the bridge member, and wherein the first terminal end of the engagement spring turns substantially perpendicularly from the longitudinally extending body of the engagement spring to form a retaining hook portion, wherein the retaining hook portion of the engagement spring is engaged with the detent.

6. The folding sight assembly of claim 5, wherein the windage adjustment knob further comprises a face positioned towards the first terminal end of the shaft of the windage adjustment knob, wherein the face comprises a plurality of ridges and grooves formed around a perimeter thereof, and wherein the engagement spring further comprises a substantially linearly formed body contiguously formed with the retaining loop portion of the engagement spring, wherein the substantially linearly formed body of the engagement spring is engaged with the plurality of ridges and grooves of the face of the windage adjustment knob.

7. The folding sight assembly of claim 6, wherein the windage adjustment knob further comprises a collar formed around the shaft of the windage adjustment knob, wherein the collar separates the shaft into a first portion and a second portion, wherein the first portion is directed towards the face and the second portion is directed towards the second terminal end of the shaft, wherein the retaining loop portion of the engagement spring is disposed on the first portion of the shaft.

8. The folding sight assembly of claim 7, wherein the catch plate has a divot formed therein, and wherein the shaft of the windage adjustment knob further comprises a protrusion extending from the second terminal end of the shaft, wherein the protrusion abuts the divot of the catch plate.

9. The folding sight assembly of claim 2, wherein the channel of the bridge member turns laterally away from the top side of the bridge member to form a detent in a lateral side of the bridge member, and wherein the first terminal end of the engagement spring turns substantially perpendicularly from the longitudinally extending body of the engagement spring to form a retaining hook portion, wherein the retaining hook portion of the engagement spring is engaged with the detent.

10. The folding sight assembly of claim 9, wherein the windage adjustment knob further comprises a face positioned towards the first terminal end of the shaft of the windage adjustment knob, wherein the face comprises a plurality of ridges and grooves formed around a perimeter thereof, and wherein the engagement spring further comprises a substantially linearly formed body contiguously formed with the retaining loop portion of the engagement spring, wherein the substantially linearly formed body of the engagement spring is engaged with the plurality of ridges and grooves of the face of the windage adjustment knob.

11. The folding sight assembly of claim 10, wherein the windage adjustment knob further comprises a collar formed around the shaft of the windage adjustment knob, wherein the collar separates the shaft into a first portion and a second portion, wherein the first portion is directed towards the face and the second portion is directed towards the second terminal end of the shaft, wherein the retaining loop portion of the engagement spring is disposed on the first portion of the shaft.

12. The folding sight assembly of claim 11, wherein the catch plate has a divot formed therein, and wherein the shaft of the windage adjustment knob further comprises a protrusion extending from the second terminal end of the shaft, wherein the protrusion abuts the divot of the catch plate.

* * * * *